United States Patent [19]

Bereziat

[11] 4,456,138

[45] Jun. 26, 1984

[54] CLOSURE HAVING GRIPPING RING MEANS FOR OPENING

[75] Inventor: Claude A. Bereziat, Thil, France

[73] Assignee: Manufacture Lyonnaise de Bouchage, Lyons, France

[21] Appl. No.: 510,236

[22] Filed: Jun. 30, 1983

[30] Foreign Application Priority Data

Jul. 1, 1982 [FR] France ..... 82 11959

[51] Int. Cl.[3] ..... B65D 41/14; B65D 41/20; B65D 41/30

[52] U.S. Cl. ..... 215/232; 215/249; 215/251; 220/257

[58] Field of Search ..... 215/232, 249, 251, 253; 220/257, 270, 276, 359

[56] References Cited

U.S. PATENT DOCUMENTS

| | | | |
|---|---|---|---|
| 4,227,617 | 10/1980 | Albrecht et al. | 215/249 |
| 4,265,364 | 5/1981 | Baha | 215/249 |
| 4,364,485 | 12/1982 | Knapp | 215/232 |

*Primary Examiner*—George T. Hall

*Attorney, Agent, or Firm*—Browdy and Neimark

[57] ABSTRACT

A sealing means is disclosed which comprises a cover of aluminum sheet or the like, fastened by gluing or heat-sealing on the surrounding part of the mouth of the container, and which is capable of being removed from the mouth surrounding part by being torn therefrom. The tearable cover projects or extends radially outwardly of the part of the container surrounding the mouth and to which it is fastened. The projecting part, about its entire periphery, is fastened by gluing, heat-sealing, or some other conventional method, to a rigid gripping ring engaged, at least partially, on the surrounding part of the container mouth.

8 Claims, 2 Drawing Figures

CLOSURE HAVING GRIPPING RING MEANS FOR OPENING

BACKGROUND OF THE INVENTION

This invention relates to means to seal a container of the type comprising a cover of aluminum sheet or the like, fastened by gluing or heat-sealing on the surrounding part of the mouth of the container.

One existing means for closing a container takes the form of a tearable cover such as an aluminum sheet, which may be plasticized, and which is fastened by gluing or heat-sealing on the surrounding part of the mouth of the container. itself, or to a sleeve that has been added to the container.

This type of seal is used, for example, for closing containers such as jars containing cream cheese. The closure is made by heat-sealing the cover directly onto the surrounding part of the mouth of a plastic container.

This type of seal is also used on certain containers for products to be injected. The closing means includes a fluid tight seal of flexible material, such as a plastic or the like, capable of being pierced by a needle for removing the product, and means for locking the seal in the neck of a container consisting of a sleeve of semirigid material, such as a plastic, provided with a catch elastically engaged under the shoulder of the neck of the container. The seal locking means defines a central opening for passage of the needle used for removing the product. This opening is closed, before use, by a tearable cover which is fastened by gluing, sealing or in any other suitable way. Such a seal is described and claimed in French Patent Application No. 81 21 627, filed Nov. 13, 1981 by the applicant.

The above-described seals are undesirable because they include a cover of aluminum sheet material that is inconvenient to pull off, and which, in any case, requires the user to have both hands available, one for holding the container and the other to pull off the tearable cover.

OBJECTS AND SUMMARY OF THE INVENTION

The principal object of this invention is to overcome the deficiencies of the prior art by the provision of a tearable cover which facilitates reliable and easy pulling off of the cover, virtually by one hand, i.e., the hand that holds the container.

For this purpose, the tearable cover is provided in such a size as to extend or project radially outwardly of the surrounding part of the mouth to which it is fastened. The projecting part of the cover, i.e., its entire periphery, is fastened by gluing, sealing or the like, with a rigid gripping ring engaged at least partially on said surrounding part of the mouth of the container. Therefore, by pulling this ring, the tearable cover that covers the mouth of the container is simultaneously pulled off.

The ring can be totally independent of the surrounding part of the mouth of the container, whether the surrounding part is integral with the container itself or comprises an added piece such as a sleeve.

The ring is advantageously made of the same material as the surrounding part of the mouth of the container so that fastening of the tearable cover to the ring is done under the same conditions as the fastening of the cover on said surrounding part.

Where the gripping ring is made of the same material as the mouth of the container, it may be made unitary with the surrounding part of the mouth of the container and may be bonded to it by bridges of material that are easy to break during pulling off of the aluminum sheet cover or, optionally, before this pulling.

Where it might be considered that the attachment of the gripping ring with the surrounding part of the mouth of the container by the bridges of material would make difficult the pulling off of the cover, and where it is considered that the presence of the bridges of material is advantageous only for positioning the gripping ring during fastening of the tearable cover therein, the ring may be positioned relative to the surrounding part of the mouth so that it is offset, in the direction corresponding to a constriction of the surrounding part in relation to it. Thus the presence necessary for fastening the tearable cover by gluing or sealing, simultaneously on the surrounding part of the mouth and on the ring, would create on the ring an axial force capable of breaking the bridges of material which secure it to the surrounding part of the mouth.

This arrangement is particularly advantageous in the case of a seal for containers containing a product to be injected because there is thus achieved in a reliable manner, a cover capable of being pulled off by one hand, so that the operator can hold the container in that hand and the injection syringe in the other hand.

BRIEF DESCRIPTION OF THE DRAWINGS

The invention will be better understood from the following description with reference to the accompanying drawings, representing by way of nonlimiting example, an embodiment of the sealing means, in which.

DETAILED DESCRIPTION OF THE INVENTION

Figure 1:
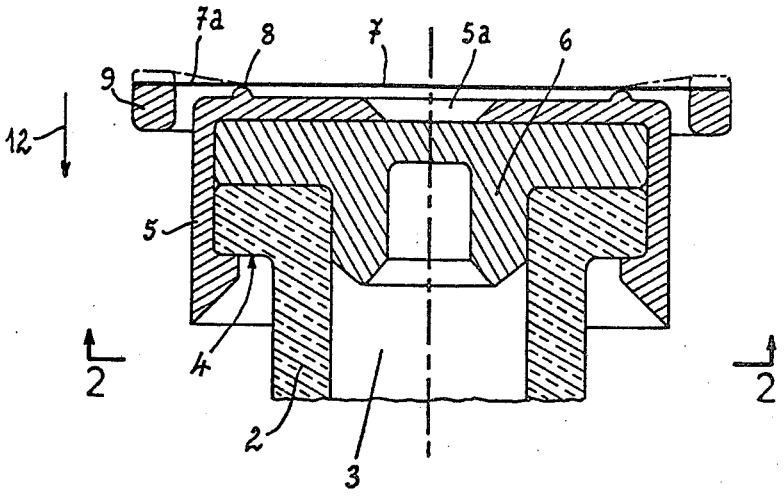
FIG. 1 is a view in section along line 1—1 of FIG. 2.
Figure 2:
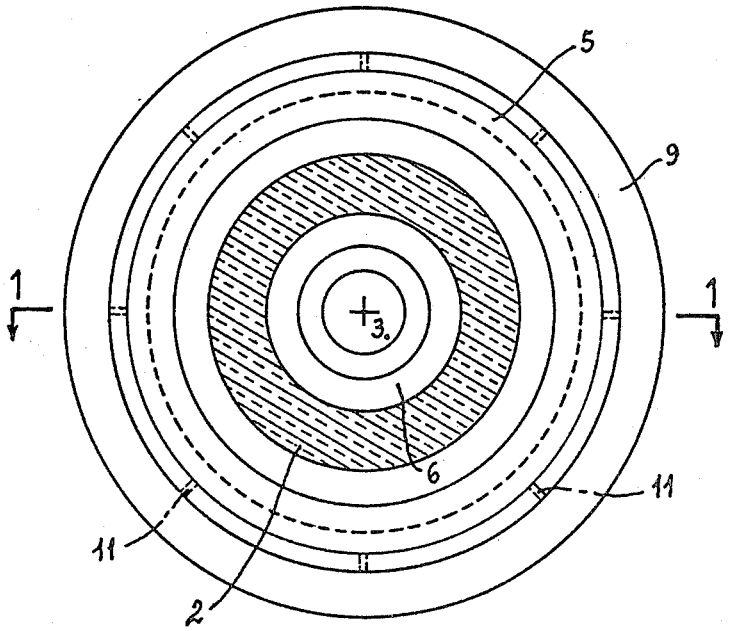
FIG. 2 is a view in section along line 2—2 of FIG. 1.

The container, as shown in the drawings, includes a neck 2 having near its upper end surrounding the mouth 3 an outside shoulder 4 on, and about, which is fastened by elastic engagement, a sleeve 5 of plastic or the like. Sleeve 5, which includes a central opening 5*a*, is employed to capture and lock seal 6 of plastic, such as an elastomer or other, between the sleeve and the shoulder 4, with seal 6 sitting atop the shoulder and extending into the container mouth 3.

A cover 7 of aluminum sheet covers the sleeve central opening 5*a* to protect seal 6 from dust or other impurities. The cover is fastened, for example by gluing, heat-sealing, etc. to the sleeve 5. In the example shown in FIG. 1 of the drawing, the cover 7 is fastened by heat-sealing to an annular rim 8 provided for this purpose on the upper outer face of the sleeve 5.

Consonant with the purpose of this invention means is provided for facilitating the removal, via pulling of the tearable cover 7 during the first use of the bottle. With this type of bottle removal of this product is done with a needle that penetrates into the mouth 3 of neck 2 by passing through the central part of the seal 6 made accessible by the central opening 5*a* of the sleeve 5. To so this, it is necessary to pull off the tearable cover 7 just before removal of the product to be injected contained in the bottle.

According to the invention, the cover 7 is of such a size as to project or extend radially beyond the sleeve 5 which constitutes the surrounding part of the mouth 3 of the bottle. This projecting part 7*a* is fastened over its entire periphery by gluing, sealing or any other way, to a rigid gripping ring 9 engaged at least partially on the free end of the sleeve 5.

Where fastening of the cover 7 to the sleeve 5 is accomplished in one of the ways mentioned above, e.g. by heat-sealing, its attachment to the gripping ring 9 is advantageously accomplished in the same way, i.e. by heat-sealing, which implies that ring 9 would be of the same material as the sleeve 5.

In that case, according to an advantageous arrangement of the invention, the gripping ring 9 is made in one piece with the sleeve 5, the ring and the sleeve being bonded by bridges of material 11 intended to be broken.

If desired, it is possible to provide that the bridges of material 11 are broken even before pulling off the tearable cover 7 so that pulling with the gripping ring 9 is not made more difficult by the bond of the cover to the sleeve 5.

In this case, it is possible to provide, as shown in FIG. 1, that during its manufacture the sleeve 5 be molded as a single piece with the gripping ring 9 offset in relation to the plane of the central opening 5*a* of the sleeve 5, so as to project in relation to this plane in the manner shown in phantom lines in FIG. 1. During heat-sealing of the cover 7 to the ring 9 and the rim 8 (preferably with a single press jaw), the press acting a ially on the ring 9, in the direction of the arrow 12, causes a movement of the ring and, consequently, the breaking of the bridges of material 11, to make it possible to put the cover 7 flat as shown in solid lines in FIG. 1.

It goes without saying that the invention is not limited to the single embodiment of the sealing means that has been described above by way of nonlimiting example; on the contrary, it encompasses all variants and equivalents.

Thus, for example, instead of consisting of the sleeve 5, the part surrounding mouth 3 of the container could consist of the same material as its neck, as is the case in certain jar-shaped containers, used for packaging cream cheese and other food items. These containers generally are made of plastic, and the neck constituting the surrounding part of the mouth can be surrounded by a gripping ring optionally bonded to the neck by bridges of the same material.

I claim as my invention:

1. Means for sealing a container of the type comprising a cover of aluminum sheet or the like, fastened by gluing or heat-sealing on the surrounding part of the mouth of the container, characterized in that said cover projects radially beyond the surrounding part of the container mouth to which it is fastened, said projecting part being secured about its entire periphery to a gripping ring, said gripping ring being engaged, at least partially, on the surrounding part of the mouth of the container, and said cover being tearable off the container mouth surrounding part.

2. Sealing means as in claim 1, wherein said gripping ring is totally independent of said mouth surrounding part.

3. Sealing means as in claim 1, wherein said gripping ring and said mouth surrounding part comprise the same material.

4. Sealing means as in claim 3, wherein said gripping ring comprises one piece, said mouth surrounding part being bonded to said gripping ring by easily breakable bridges of material.

5. Sealing means as in claim 4, wherein said ring is positioned relative to said mouth surrounding part in offset relationship thereto so that the pressure necessary for fastening said tearable cover simultaneously on said mouth surrounding part and on said ring creates an axial force on said ring capable of breaking said bridges of material which attach said ring to said mouth surrounding part.

6. Sealing means as in claim 2, wherein said gripping ring and said mouth surrounding part comprise the same material.

7. Sealing means as in claim 6, wherein said gripping ring comprises one piece, said mouth surrounding part being bonded to said gripping ring by easily breakable bridges of material.

8. Sealing means as in claim 7, wherein said ring is positioned relative to said mouth surrounding part in offset relationship thereto so that the pressure necessary for fastening said tearable cover simultaneously on said mouth surrounding part and on said ring creates an axial force on said ring capable of breaking said bridges of material which attach said ring to said mouth surrounding part.

* * * * *